United States Patent [19]

Inada et al.

[11] 4,219,250

[45] Aug. 26, 1980

[54] INTEGRATED CONTROL DEVICE

[75] Inventors: Masami Inada, Kariya; Shoji Ito, Nagoya; Kazauhiko Kitamura, Toyota; Toshiro Harada, Okazaki, all of Japan

[73] Assignees: Aisin Seiki Kabushiki Kaisha, Kariya; Toyota Jidosha Kogyo Kabushiki Kaisha, Toyota, both of Japan

[21] Appl. No.: 9,651

[22] Filed: Feb. 5, 1979

[30] Foreign Application Priority Data

Feb. 6, 1978 [JP] Japan ..... 53/12145

[51] Int. Cl.[3] ..... H01R 4/64

[52] U.S. Cl. ..... 339/15; 60/288; 137/596.17; 339/35

[58] Field of Search ..... 60/288; 339/15, 14, 339/35; 137/597.17, 608

[56] References Cited

U.S. PATENT DOCUMENTS

| | | | |
|---|---|---|---|
| 2,758,447 | 8/1956 | Prosek | 137/597.17 |
| 3,911,674 | 10/1975 | Goto et al. | 60/288 X |

*Primary Examiner*—Roy Lake
*Assistant Examiner*—DeWalden W. Jones
*Attorney, Agent, or Firm*—Finnegan, Henderson, Farabow, Garrett & Dunner

[57] ABSTRACT

An integrated control device has a plurality of exhaust gas control units and base board means for mounting the control units thereon. The base board means is provided with fluid passage means and port opening means communicating therewith and adapted to be mated with port means in the control units so as to establish necessary fluid communication among the control units. Thus, the arrangement of the components used in an exhaust gas cleaning system can be made compact and readily accessible.

7 Claims, 8 Drawing Figures

INTEGRATED CONTROL DEVICE

The present invention relates to an integrated control device having a plurality of control units. More particularly, the present invention pertains to an integrated control device composed of a plurality of control units which are adapted to be used in an exhaust gas cleaning system for an automobile engine.

An exhaust gas cleaning system for a conventional automobile engine includes several control units such as suction pressure responsive control valves, suction pressure delay valves, suction pressure switching valves and suction pressure responsive switches which are suitably connected through pipings such as tubes and rubber hoses. Since this type of system has complicated pipings, an increased labour and time are consequently required in assembling the system and inconveniencies are encountered in maintenance. Further, it has been difficult to provide an improved appearance in the automobile engine compartment. In order to solve the above problems, it has been proposed to provide a plurality of control units in a single housing or to assemble such control units by suitable means such as a clamp. However, such proposals have not been effective in satisfactorily solving the problems.

It is therefore an object of the present invention to provide means for solving the aforementioned problems in a conventional exhaust gas cleaning system for an automobile engine.

Another object of the present invention is to provide an integrated control device in which a plurality of control units are assembled on a single plate.

A further object of the present invention is to provide a compact arrangement of control units for an exhaust gas cleaning system.

A still further object of the present invention is to provide an exhaust gas cleaning system which is convenient for maintenance.

According to the present invention, the above and further objects can be accomplished by an integrated control device comprising a plurality of exhaust gas control units respectively having port means, and base board means for mounting said control units thereon, said control units having sides adapted to be engaged with said base board means for mounting the units thereon, said port means on each control unit being formed on said side, fluid passage means formed in said base board means, said base board means having port opening means communicating with said fluid passage means and adapted to be mated with said port means in said control units for establishing necessary fluid communication among the control units.

According to a further aspect of the present invention, at least one of the control units has electrical contact means provided on said side of the control unit, said base board means having electric circuit means having cooperating contact means adapted to be engaged with said contact means on said control unit.

According to the present invention, since all control units required for an engine exhaust gas cleaning system can be mounted on a single base board means, a compact and readily accessible arrangement can be obtained.

The above and other objects and features of the present invention will become apparent from the following description of preferred embodiments with reference to the accompanying drawings, in which.

Figure 1:
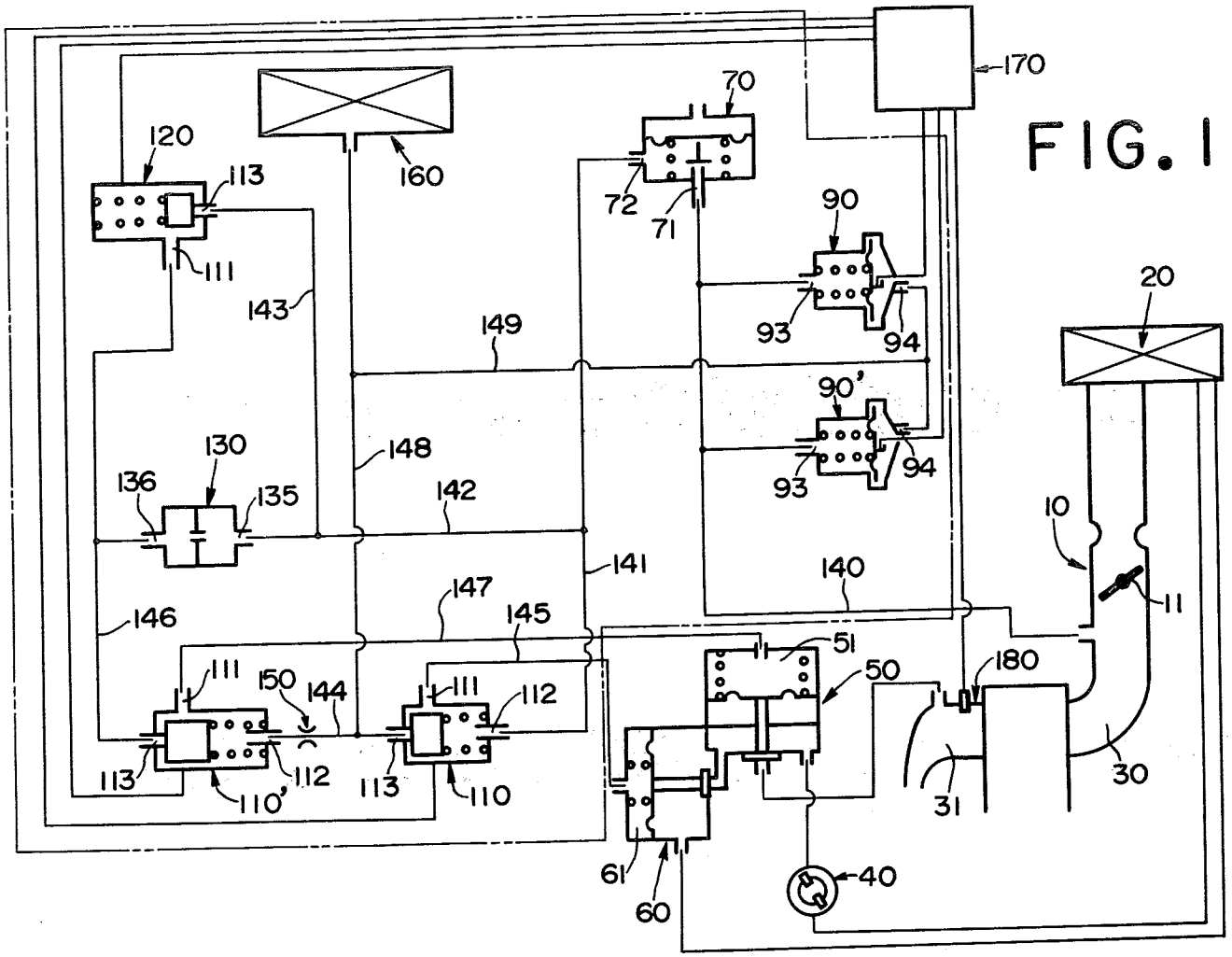
FIG. 1 is a diagram showing an example of a secondary air supply system for an automobile engine.

Referring to the drawings, particularly to FIG. 1, there is shown an example of a secondary air supply system for an automobile engine. As well known in the art, the secondary air supply system is designed to introduce air into the engine exhaust system to that unburnt constituents such as CO and HC in the exhaust gas are reacted with oxygen in the secondary air. In the system, a carburetor 10 having a throttle valve 11 is connected at the upstream side of the throttle valve 11 with an air cleaner 20 and at the downstream side of the throttle valve 11 with an intake manifold 30 of the engine.

An air pump 40 is provided for drawing air from the air cleaner 20 and has an outlet connected through an air shut-off valve 50 with an exhaust manifold 31 of the engine. The air shut-off valve 50 is associated with a relief bypass valve 60 which functions to shut-off momentarily the supply of the secondary air from the air pump 40 to the exhaust manifold 31 and bypass the air to the air cleaner 20 in case of a rapid deceleration of the engine in order to avoid afterburning.

Figure 2:
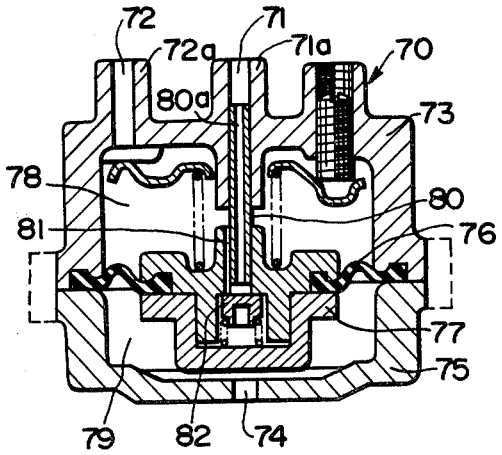
FIG. 2 is a sectional view of a suction pressure responsive control valve used in the system shown in FIG. 1.

Referring now to FIG. 2, there is shown a suction pressure responsive control valve 70 which is composed of a first body 73 having an inlet port 71 and an outlet port 72, and a second body 75 having a vent port 74, the first and second bodies 73 and 75 being connected together to form a valve housing. Between the first and second bodies 73 and 75, there is disposed a diaphragm 76 and secured at its inner periphery with a diaphragm piston 77.

The diaphragm 76 separates the inside of the valve housing into a diaphragm chamber 78 and an atmospheric pressure chamber 79, the diaphragm chamber 78 being connected with the outlet port 72 and the atmospheric pressure chamber 79 with the vent port 74. The suction pressure applied to the inlet port 71 is transmitted through a passage 80*a* in a pipe 80 and a passage 81 defined between the inner periphery of the diaphragm piston 77 and the outer periphery of the pipe 80 to the diaphragm chamber 78. As the suction pressure in the diaphragm chamber 78 is increased to a predetermined value, a valve member 82 provided in the diaphragm piston 77 is moved to a position wherein it contacts with the lower end of the pipe 80 to close the passage 80*a* so as to disconnect the inlet port 71 from the outlet port 72. Thus, it will be understood that the valve functions to provide a substantially constant suction at the outlet port 72. In FIG. 2, it should be noted that the inlet port 71 and the outlet port 72 are formed respectively in pipe-like portions 71*a* and 72*a* provided on the same side of the first body 73.

Figure 3:
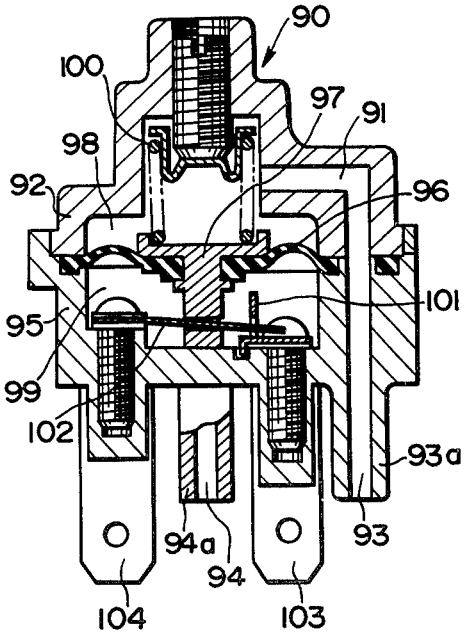
FIG. 3 is a sectional view of a suction pressure responsive switch used in the system shown in FIG. 1.

Referring to FIG. 3, there is shown a suction pressure responsive switch 90 which is composed of a first body 92 having a passage 91, and a second body 95 having an inlet port 93 and a vent port 94, the first and second bodies 92 and 95 being connected together to form a switch housing. Between the bodies 92 and 95, there is disposed a diaphragm 96 which is secured to the housing at its outer periphery and to a diaphragm piston 97 at its inner periphery. The diaphragm 96 divides the inside of the switch housing into a diaphragm chamber 98 and an atmospheric pressure chamber 99, the diaphragm chamber 98 being communicated through the passage 91 with the inlet port 93 and the atmospheric pressure chamber 99 with the vent port 94.

Suction pressure is applied to the inlet port 93 and transmitted to the diaphragm chamber 98. As the suction pressure in the diaphragm chamber 98 increases to a predetermined value, the diaphragm piston 97 is moved upwardly in the drawing against the function of a spring 100 so that a movable contact 102 is brought into engagement with a stationary contact 101 to establish an electrical contacts between terminals 103 and 104. It should be noted that the inlet port 93 and the atmospheric pressure port 94 are respectively formed in pipe-like portions 93*a* and 94*a* provided on the same side of the second body 95. Further, the terminals 103 and 104 are also provided on the same side of the second body 95 as the pipe-like portions 93*a* and 94*a*.

Figure 4:
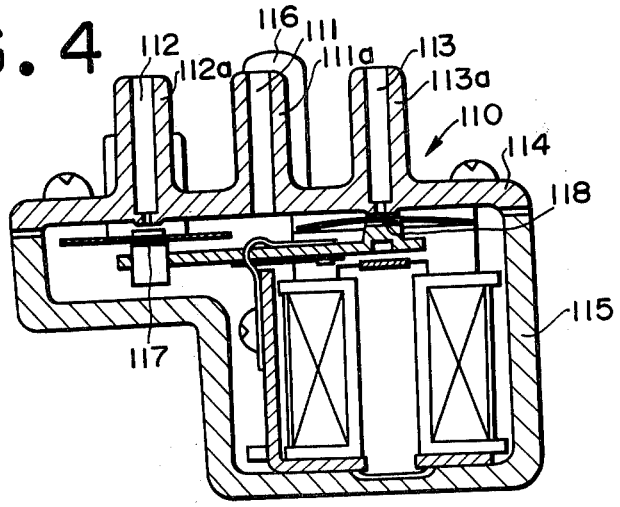
FIG. 4 is a sectional view of a suction pressure responsive switching valve used in the system shown in FIG. 1.

Referring now to FIG. 4, there is shown a suction pressure responsive switching valve 110 which is composed of a first body 114 having an inlet port 111, a first outlet port 112 and a second outlet port 113, and a second body 115 which is secured to the first body 114 to form a valve housing. The first outlet port 112 is associated with a first valve member 117 which is normally in the open position as shown to establish a communication between the inlet port 111 and the first outlet port 112, but is moved to a closed position wherein it closes the first outlet port 112 when a solenoid is energized through an electrical contact 116.

The second outlet port 113 is associated with a second valve member 118 which is normally maintained in the closed position as shown but moved to the open position when the aforementioned solenoid is energized to establish a communication between the inlet port 111 and the second outlet port 113. Thus, it will be noted that the first and second outlet ports 112 and 113 are alternately brought into communication with the inlet port 111. It should be noted that the inlet port 111, the first outlet port 112 and the second outlet port 113 are respectively formed in pipe portions 111*a*, 112*a* and 113*a* which are provided on the same side of the first body 114. Further, the electric terminal 116 is also provided on the same side of the first body 114 as the pipe portions 11*a*, 112*a* and 113*a*.

In the system shown in FIG. 1, there is used a further suction pressure responsive switching valve 120 which is similar in construction with the switching valve 110 except that the first outlet port 112 is omitted. Thus, in the valve 120, the communication between the inlet port 111 and the second outlet port 113 is controlled by an electrical signal.

Figure 5:
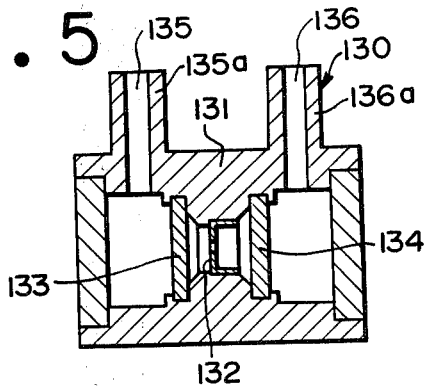
FIG. 5 is a sectional view of a jet used in the system shown in FIG. 1.

Referring to FIG. 5, there is shown a jet 130 which includes a body 131 having an orifice 132 provided in the center port of the body 131. At the opposite sides of the orifice 132, there are provided air filters 133 and 134. The body 131 is formed with an inlet port 135 which is communicated through the filter 133, the orifice 132 and the filter 134 with an outlet port 136 which is also provided on the body 131. The inlet port 135 and the outlet port 136 are respectively formed in pipe portions 135*a* and 136*a* which are provided on the same side of the body 131.

Referring back to FIG. 1, a passage 140 is provided to connect the intake manifold 30 of the engine with the inlet port 71 of the control valve 70 and the inlet port 93 of the pressure switch 90. A further suction pressure responsive 90′ which is identical in construction to the switch 90 and has an inlet port 93 is also provided in the system and connected at the inlet port 93 with the passage 140. The outlet port 72 of the control valve 70 is connected through a passage 141 with the first outlet port 112 of the switching valve 110 and through a passage 142 with the inlet port 135 of the jet 130. The passage 142 is at the same time connected with a passage 143 which leads to the outlet port 113 of the switching valve 120.

The second outlet port 113 of the switching valve 110 is connected with a passage 144 having an orifice 150. There is also provided a further suction pressure switching valve 110′ which is identical to the switching valve 110 and has an inlet port 111, a first outlet port 112 and a second outlet port 113. The passage 144 is connected through the orifice 150 with the first outlet port 112.

The inlet port 111 of the switching valve 110 is connected through a passage 145 with the diaphragm chamber 61 of the relief bypass valve 60.

The switching valve 110′ is connected at its second outlet port 113 through a passage 146 with the outlet port 136 of the jet 130 and with the inlet port 111 of the switching valve 120. The inlet port 111 of the switching valve 110′ is connected through a passage 147 with the diaphragm chamber 51 of the air shut-off valve 50.

An air filter 160 is provided to introduce clean air through a passage 148 to the passage 144 and through a passage 149 to the vent ports 94 in the pressure switches 90 and 90′. A computer 170 is provided and has circuits for converting intake manifold pressure signals from the switches 90 and 90′ and an engine coolant temperature signal from a temperature sensing probe 180 into electrical signals which are applied to switching valves 110, 110′ and 120.

Figure 6:
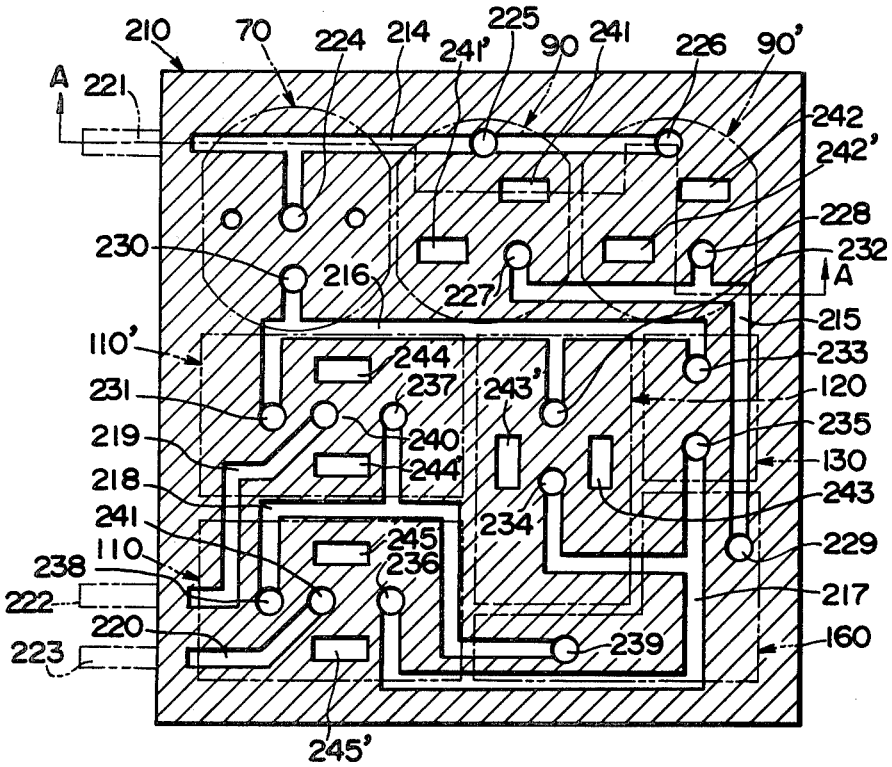
FIG. 6 is a sectional view of an integrated control device in accordance with one embodiment of the present invention.
Figure 7:
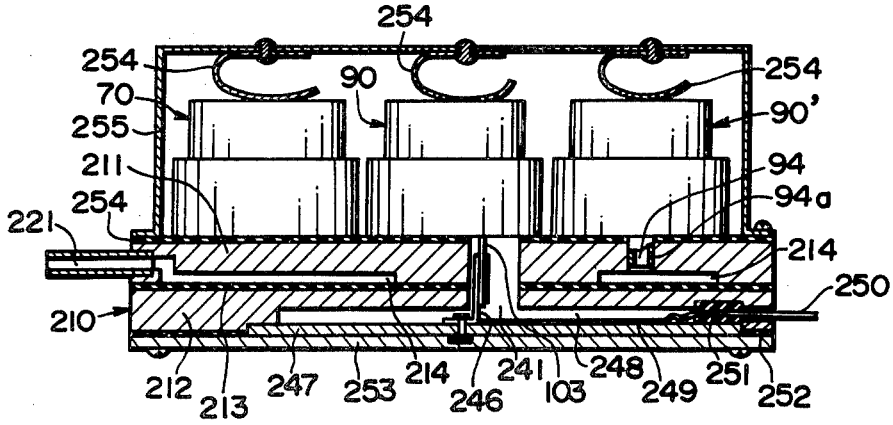
FIG. 7 is a sectional view taken substantially along the line A—A in FIG. 6; and, FIG. 8 is a sectional view of an integrated control device in accordance with another embodiment of the present invention.

FIGS. 6 and 7 show an embodiment of a control device which is constituted by integrating the control units are encircled by a dot-and-dash line in FIG. 1. The control device includes a base board 210 which comprises a first plate 211 and a second plate 212 connected together with an intervention of a sealing member 213 made of a suitable resilient material such as rubber.

Between the first plate 211 and the seal member 213, there are formed fluid passages 214, 215, 216, 217, 218, 219 and 220. The passage 214 is adapted to be connected through an inlet port 221 formed in the first plate 211 with the intake manifold 30 of the engine. The passage 219 is connected through a first outlet port 222 with the diaphragm chamber 61 of the relief bypass valve 60, and the passage 220 is connected through a second outlet port 223 with the diaphragm chamber 51 of the shut-off valve 50.

On the first plate 211, there are formed port openings 224, 225 and 226 which are in communication with the passage 214, port openings 227, 228 and 229 which are in communication with the passage 215, port openings 230, 231, 232 and 233 which are in communication with the passage 216, port openings 234, 235 and 236 which are in communication with the passage 217, port openings 237, 238 and 239 which are in communication with passage 218, a port opening 240 which is in communication with the passage 219, and a port opening 241 which is in communication with the passage 220.

The base board 210 further has pairs of communication holes 241 and 241'; 242 and 242'; 243 and 243'; 244 and 244'; and 255 and 255'. Further, there is provided an electric contact 246 which is secured to a plate 247 and electrically connected with the computer 170 through a printed lead 249 and a lead 250 in the passage 248 of the second plate 212. The lead 250 is covered by a sealing material 251 so that it is protected from any contamination by foreign materials such as water or dusts. The plate 247 is secured in place by means of a cover plate 253 which is secured to the second plate 212 through a sealing member 252.

On the base board 210, there are secured respective control units with sealing members 254 intervened between the base board 210 and the control units. More specifically, the control valve 70 is secured thereto with the pipe portions 71*a* and 72*a* for the inlet port 71 and the outlet port 72 inserted into the port openings 224 and 230 on the base board 210. The suction pressure switch 90 is mounted on the board 210 with the pipe portions 93*a* and 94*a* for the inlet port 93 and the vent port 94 inserted respectively into the port openings 225 and 227, and the electric terminals 103 and 104 inserted into the openings 241 and 241', respectively, to be brought into contact with the terminal 246 so that they are connected with the computer 170.

The suction pressure switch 90' is mounted in such a manner that the pipe portions 93*a* and 94*a* for the inlet port 93 and the vent port 94 are respectively inserted into the port openings 226 and 228, and the electric terminals 103 and 104 are inserted respectively into the openings 242 and 242' to be brought into contact with electric terminals so that they are connected with the computer 170. The switching valve 110 is mounted in such as way that the pipe portions 111*a*, 112*a* and 113*a* for the inlet port 111, the first outlet port 112 and the second outlet port 113 are respectively inserted into the port openings 231, 237 and 240, and the pair of electric terminals 116 are inserted into the openings 244 and 244' to contact with the electric terminal leading to the computer 170. The switching valve 110' is mounted in such a manner that the pipe portions 111*a*, 112*a* and 113*a* for the inlet port 111, the first outlet port 112 and the second outlet port 113 are respectively inserted into the port openings 238, 236 and 241, and the paired electric terminals 116 are inserted into the paired openings 245 and 245' so that they are brought into contact with the electric terminals leading to the computer 170.

The switching valve 120 is mounted in such a manner that the pipe portions 111*a* and 112*a* for the inlet port 111 and the outlet port 112 are respectively inserted into the port openings 232 and 234, and the paired electric terminals 116 are inserted into the paired openings 243 to be brought into contact with the electric terminals leading to the computer 170. The jet 130 is mounted with pipe portions 135*a* and 136*a* for the inlet port 135 and the outlet port 136 are respectively inserted into the port openings 233 and 235. The filter 160 also has pipe portions inserted into the port openings 229 and 239.

After the control units have been mounted on the base board 210 in a manner as described above, a cover 255 is secured to the base board 210 so that the units are maintained under the influence of springs 254 on the cover into firm sealing contact with the base board.

Figure 8:
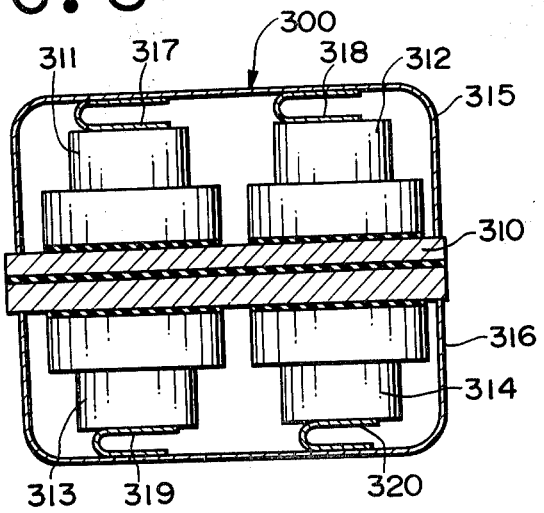

Referring now to FIG. 8 which shows an integrated control device 300 in accordance with another embodiment of the present invention, the device 300 has a base board 310 which has opposite side surfaces carrying the exhaust gas control units. More specifically, control units 311 and 312 are mounted on the upper side of the base board 310 and control units 313 and 314 are mounted on the lower side. Covers 315 and 316 have springs 317, 318, 319 and 320 which function to maintain the control units 311, 312, 313 and 314 firmly in sealing engagement with the base board.

In this embodiment, the base board is formed at the upper surface with port openings for fluid passages and the control units 311 and 312 may be the ones similar to the control valve 70 shown in FIG. 2 or the jet 130 shown in FIG. 5. On the lower surface of the base board, there are formed port openings for fluid passages and openings for electric terminals so that the control units 313 and 314 may be the ones similar to the suction pressure switch 90 shown in FIG. 3 or the switching valve 110 shown in FIG. 4.

From the above descriptions, it will be understood that in accordance with the present invention control units such as suction pressure responsive control valves, suction pressure switching valves and suction pressure responsive switches are mounted on a single base board which has fluid passages and optionally electric circuits. Therefore, the arrangement of the components in the exhaust gas cleaning system can be made compact and readily accessible.

The invention has thus been shown and described with reference to specific embodiments, however, it should be noted that the invention is in no way limited to the details of the illustrated structures but changes and modifications may be made without departing from the scope of the appended claims.

What is claimed is:

1. An integrated control device which comprises a plurality of exhaust gas control units each having port means; and base board means for removably mounting said control units thereon, said control units each having a side adapted to be engaged with said base board means for mounting each of the units thereon, said port means on each control unit being formed on said side, said base board means including fluid passage means formed therein, and said base board means having port opening means communicating with said fluid passage means and adapted to be mated with said port means in said control units for establishing necessary fluid communication among the control units.

2. An integrated control device in accordance with claim 1 wherein at least one of the control units has electrical contact means provided on said side of the control unit, and said base board means includes electric circuit means having cooperating contact means adapted to be engaged with said contact means on said control unit.

3. An integrated control device in accordance with claim 1 in which said control units are mounted on one side of the base board means.

4. An integrated control device in accordance with claim 1 in which said control units are mounted on opposite sides of the base board means.

5. An integrated control device in accordance with claim 2 in which the control units having the electrical contact means are mounted on one side of the base board means and the control units having no electrical contact means are mounted on the opposite side of the base board means.

6. An integrated control device in accordance with claim 1 in which cover means is provided to cover the control units, said cover means having resilient means for forcing the control units into firm engagement with the base board means.

7. An integrated control device in accordance with claim 1 in which said port means on each control unit includes pipe means projecting from said side of the unit and adapted to be inserted into cooperating ones of the port opening means in the base board means.

* * * * *